US010604214B2

(12) United States Patent
Jesewitz

(10) Patent No.: US 10,604,214 B2
(45) Date of Patent: Mar. 31, 2020

(54) RETRACTABLE SHADE APPARATUS FOR BOATS

(71) Applicant: Raymond L. Jesewitz, Apopka, FL (US)

(72) Inventor: Raymond L. Jesewitz, Apopka, FL (US)

( * ) Notice: Subject to any disclaimer, the term of this patent is extended or adjusted under 35 U.S.C. 154(b) by 4 days.

(21) Appl. No.: 15/730,727

(22) Filed: Oct. 11, 2017

(65) Prior Publication Data

US 2019/0127026 A1 May 2, 2019

Related U.S. Application Data

(60) Provisional application No. 62/406,923, filed on Oct. 11, 2016.

(51) Int. Cl.
*B63B 17/02* (2006.01)

(52) U.S. Cl.
CPC ..... *B63B 17/02* (2013.01)

(58) Field of Classification Search
CPC ..... B63B 17/02
See application file for complete search history.

(56) References Cited

U.S. PATENT DOCUMENTS

| | | | | |
|---|---|---|---|---|
| 3,165,762 | A * | 1/1965 | Hage | B63B 17/02 114/361 |
| 6,439,150 | B1 * | 8/2002 | Murphy | B63B 17/02 114/361 |
| 7,395,774 | B2 * | 7/2008 | Borges | B63B 17/02 114/361 |
| 7,571,691 | B2 * | 8/2009 | Russikoff | B63B 17/02 114/361 |
| 7,895,964 | B2 * | 3/2011 | Russikoff | B63B 17/02 114/361 |
| 8,857,366 | B2 * | 10/2014 | Russikoff | B63B 17/02 114/361 |
| 9,139,258 | B2 * | 9/2015 | Russikoff | B63B 17/02 |
| 9,227,699 | B2 * | 1/2016 | Raiter | B63B 1/12 |
| 2008/0022916 | A1 * | 1/2008 | Borges | B63B 17/02 114/361 |
| 2011/0290170 | A1 * | 12/2011 | Russikoff | B63B 17/02 114/361 |
| 2013/0206050 | A1 * | 8/2013 | Russikoff | B63B 17/02 114/361 |
| 2017/0264224 | A1 * | 9/2017 | Becker | H02P 7/03 |
| 2019/0127026 | A1 * | 5/2019 | Jesewitz | B63B 17/02 |

* cited by examiner

*Primary Examiner* — S. Joseph Morano
*Assistant Examiner* — Jovon E Hayes
(74) *Attorney, Agent, or Firm* — Paul Royal, Jr.; The Patent Guild

(57) ABSTRACT

An Extendable/Retractable Shade Apparatus for attachment to a boat tower or boat top or boat cargo rack.

13 Claims, 23 Drawing Sheets

RETRACTABLE SHADE APPARATUS FOR BOATS

CROSS-REFERENCE TO RELATED APPLICATIONS

Figure 1:
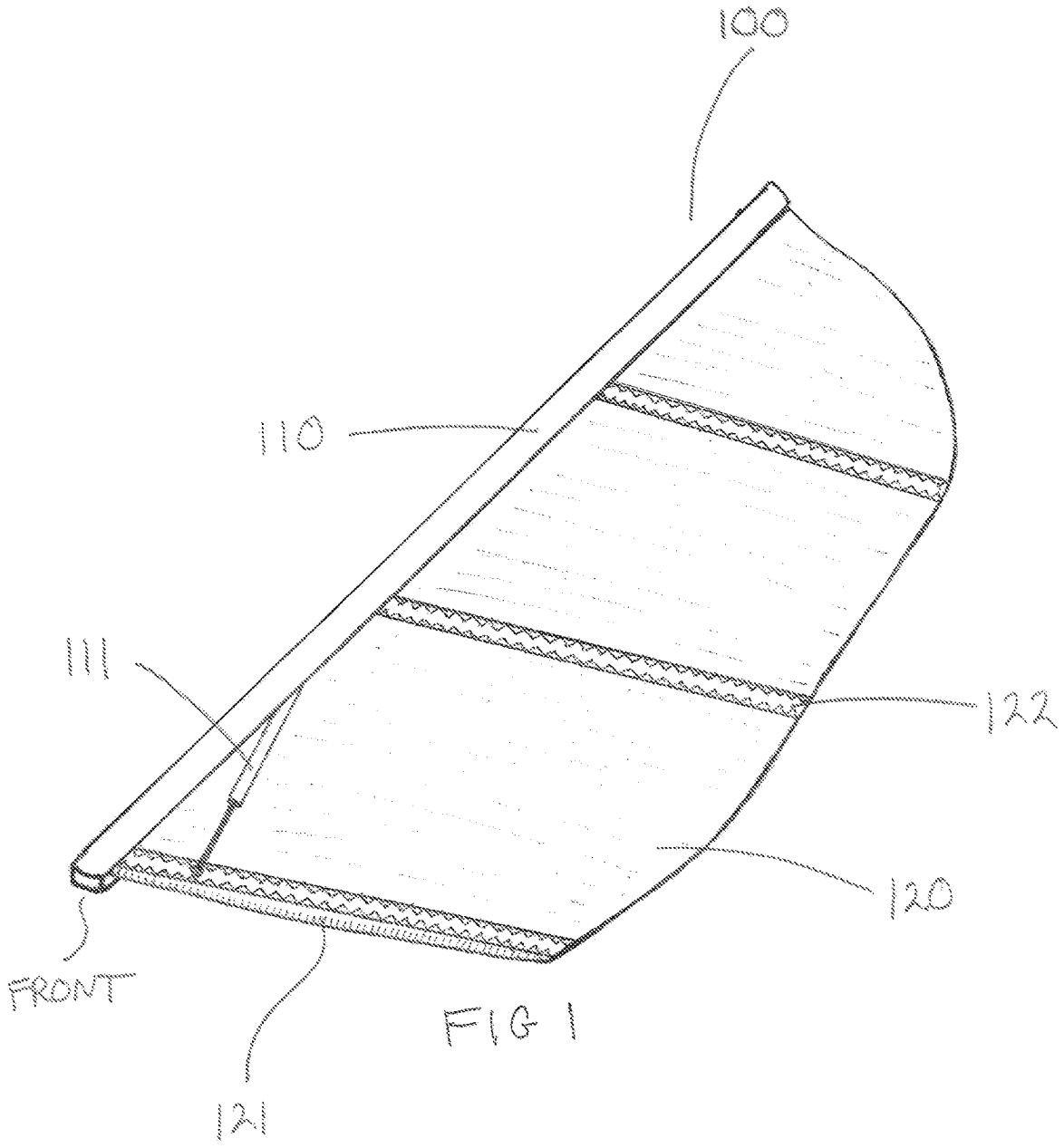

This application claims the benefit of U.S. Provisional Patent Application 62/406,923 filed 11 Oct. 2016.

STATEMENT REGARDING FEDERALLY SPONSORED RESEARCH OR DEVELOPMENT

None.

BACKGROUND OF THE INVENTION

Field of the Invention

The instant invention provides a boat top mounted shade device that is extendable/retractable to provide adjustable overhead coverage.

BRIEF SUMMARY OF THE INVENTION

It is an object of the instant invention/apparatus to provide a boat top mounted shade device that is extendable/retractable to provide adjustable overhead coverage (such as shade from the Sun), presented herein as a Retractable Shade Apparatus for Boats.

The shade device may also be a horizontally pivoting device. One of the benefits of the horizontal pivoting design is that the boater will not hit his/her head on the shade device as it remains substantially level with the height of the boat T-top. This is in contrast to shade devices that hinge down creating a safety hazard. Another benefit of the design is that the sun coverage is maximized due to the fact that the spines may protrude outward toward the full beam width of the boat on the port and starboard sides.

The Retractable Shade Apparatus for Boats provides gas-assisted, manual, or remotely powered operation for ease of use which provides an increase in coverage for sun protection and comfort. High-strength spines provide proper stiffness to enable use while at running speeds.

BRIEF DESCRIPTION OF THE SEVERAL VIEWS OF THE DRAWING(S)

The apparatus will be better understood and objects other than those set forth above will become apparent when consideration is given to the following detailed description thereof. Such description makes reference to the annexed drawings, wherein:

FIG. 1 presents an extended Retractable Shade Apparatus for Boats.

Figure 2:
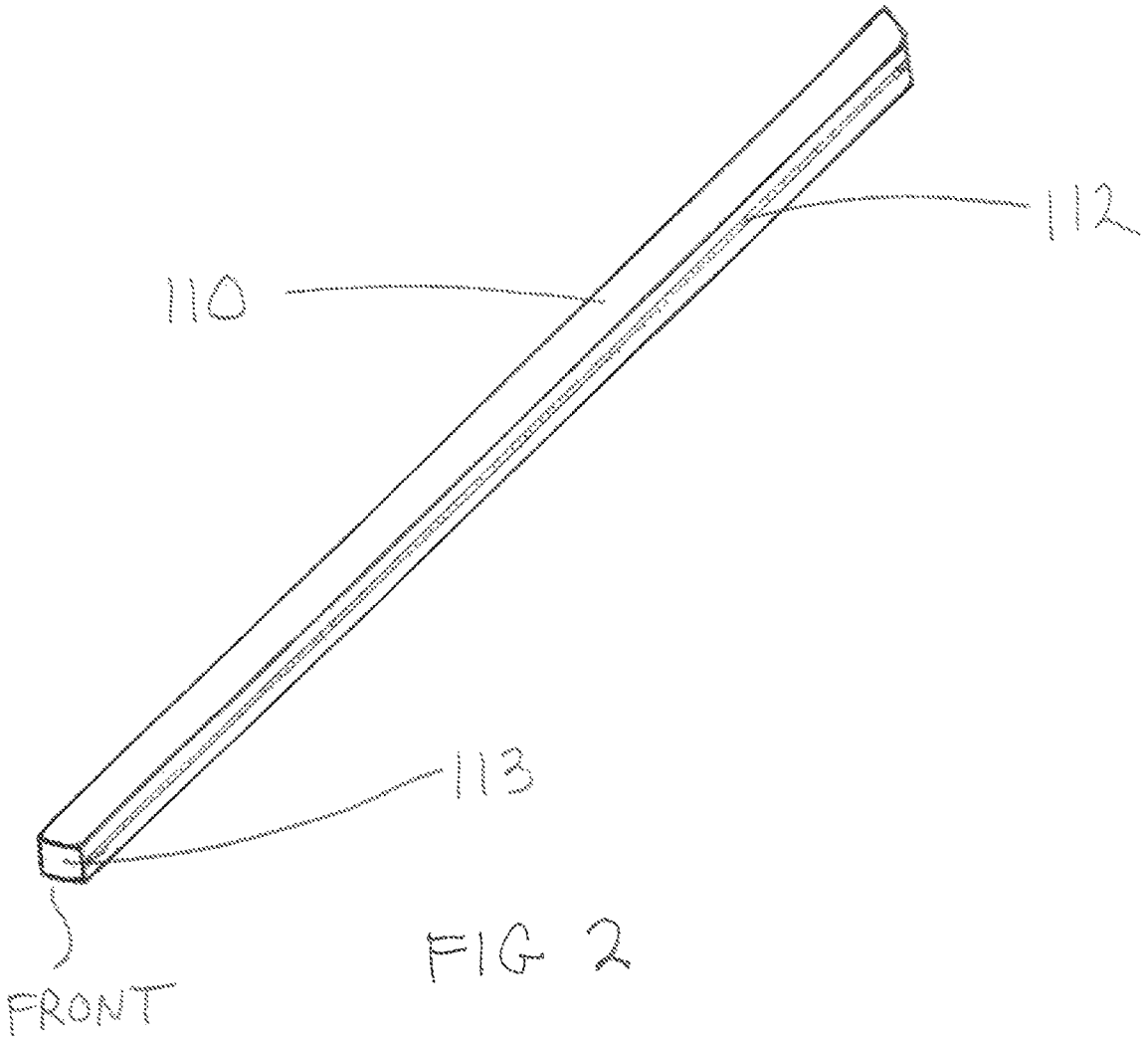

FIG. 2 presents a retracted Retractable Shade Apparatus for Boats.

Figure 3:
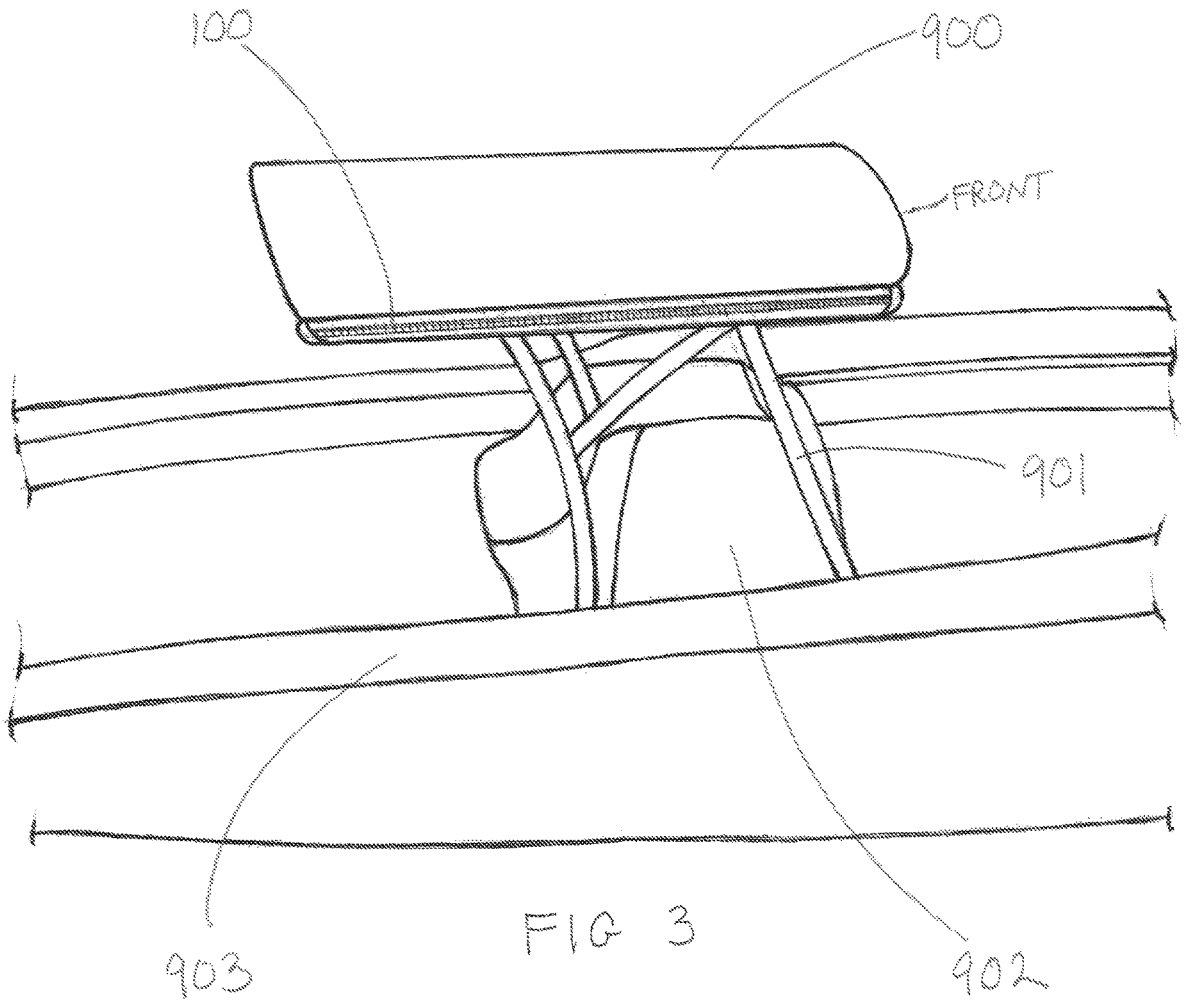

FIG. 3 presents a Retractable Shade Apparatus for Boats attached to a boat T-top.

Figure 4:
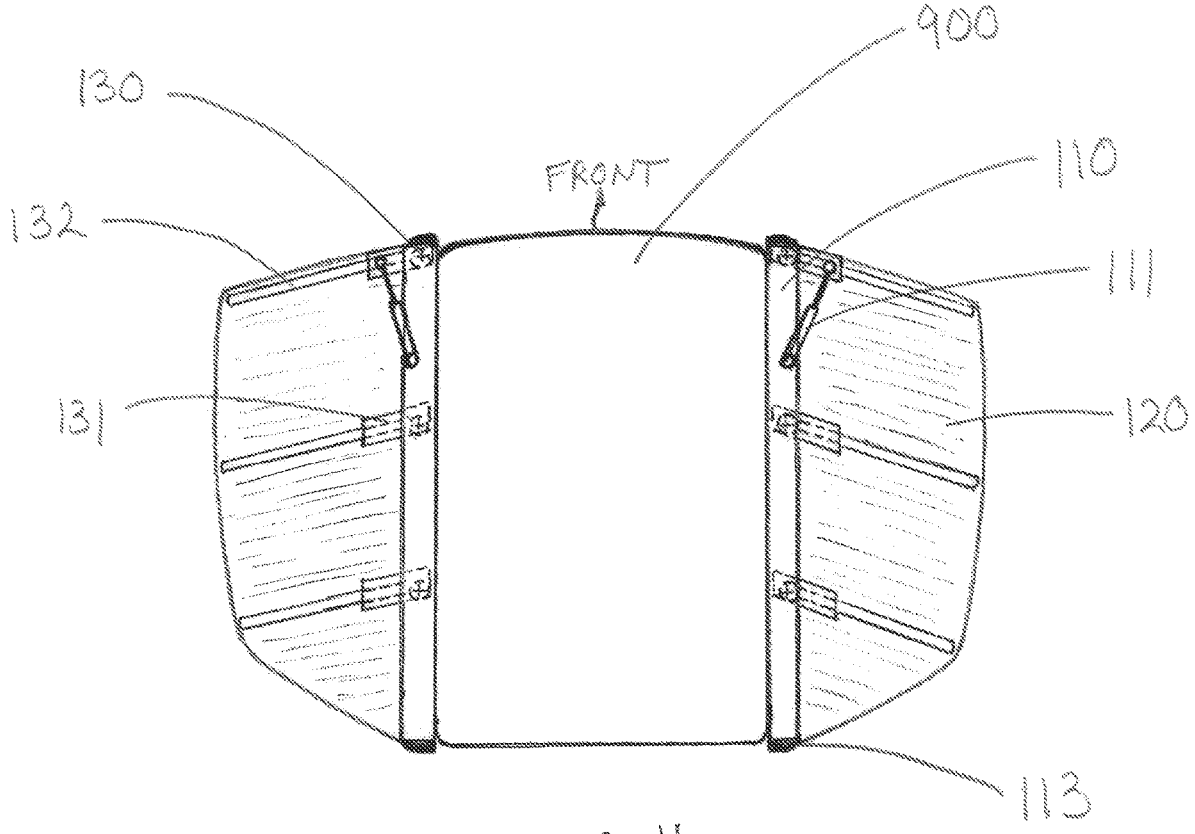

FIG. 4 presents an extended Retractable Shade Apparatus for Boats.

Figure 5:
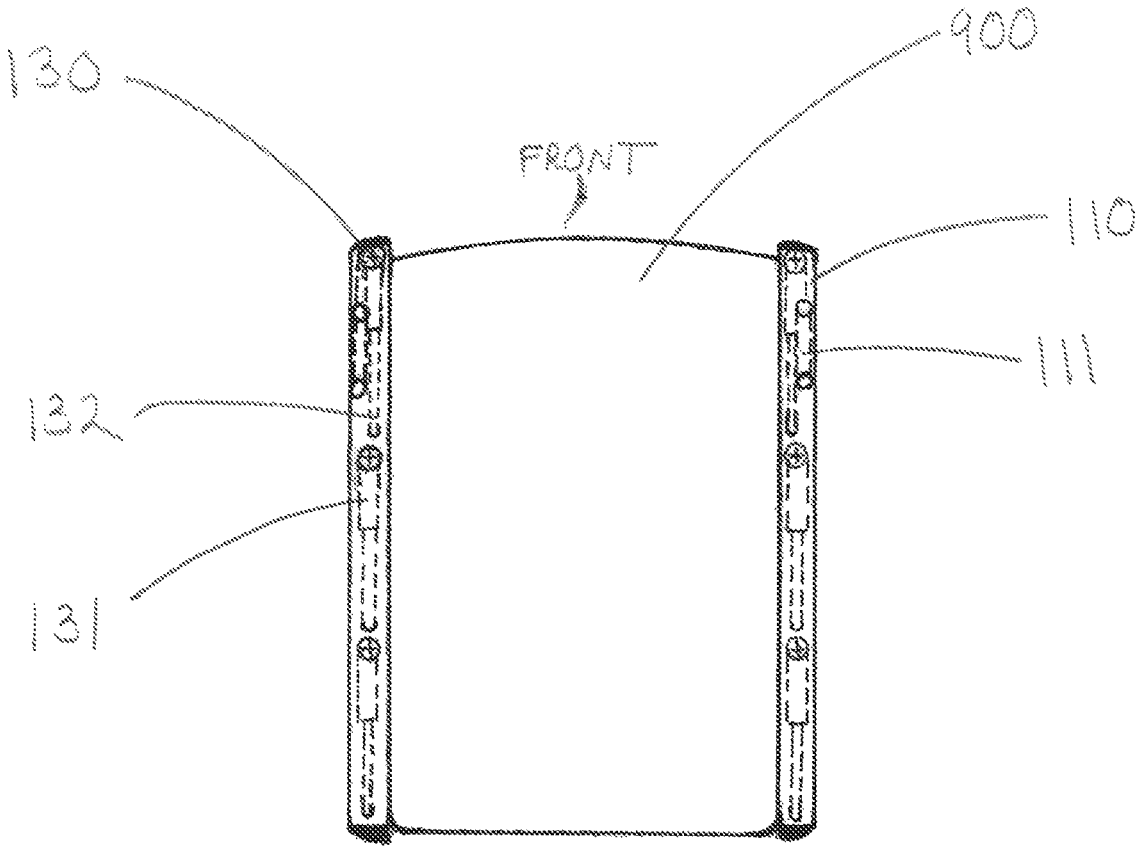

FIG. 5 presents a retracted Retractable Shade Apparatus for Boats.

Figure 6:
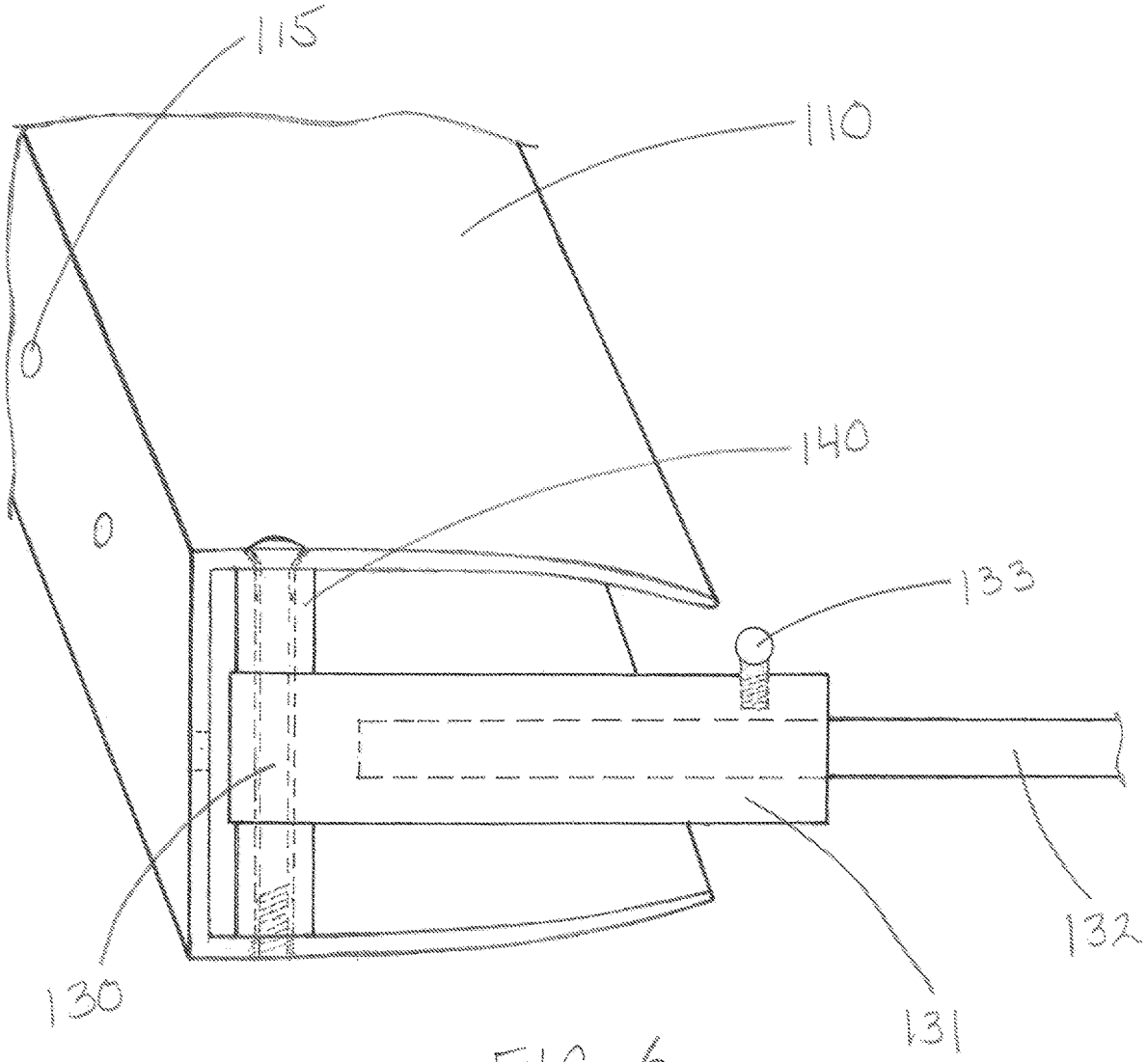

FIG. 6 presents a pivot mechanism.

Figure 7:
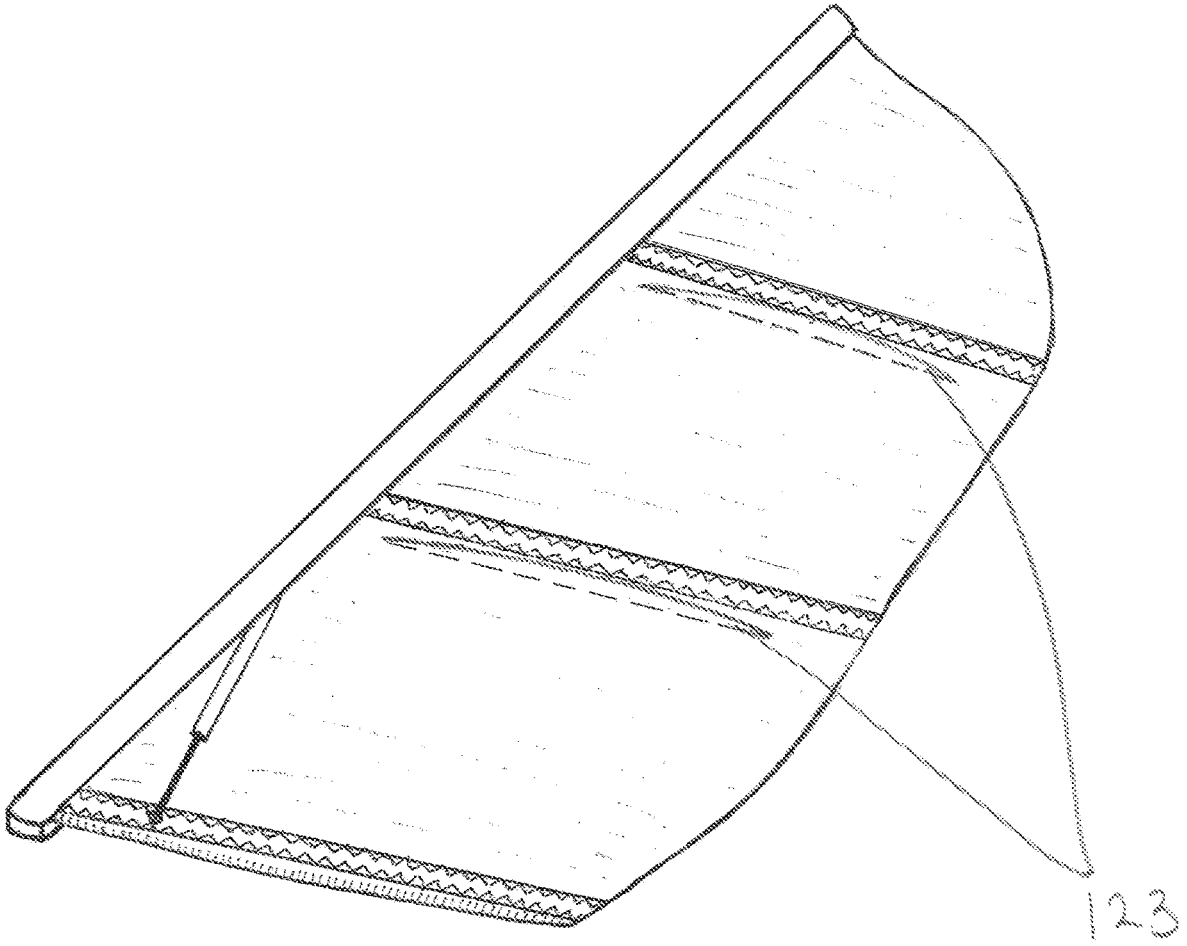

FIG. 7 presents an extended Retractable Shade Apparatus for Boats.

Figure 8:
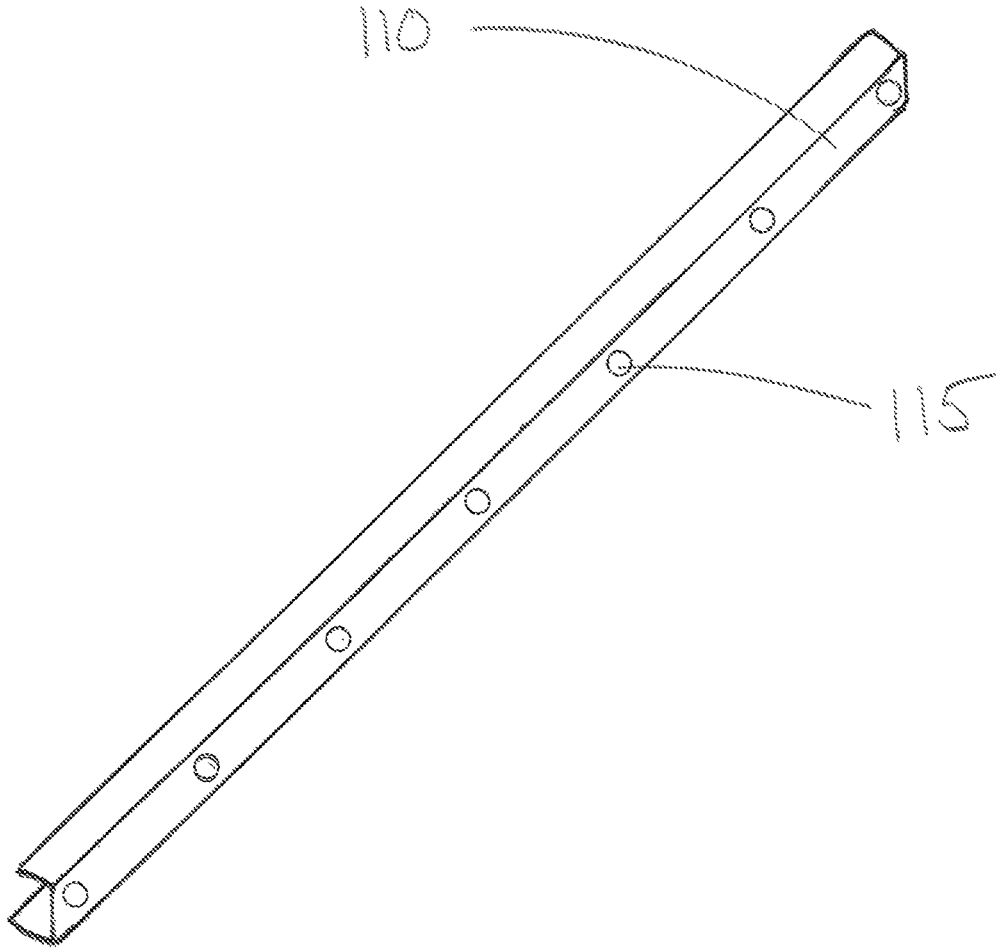

FIG. 8 presents a retracted Retractable Shade Apparatus for Boats.

Figure 9:
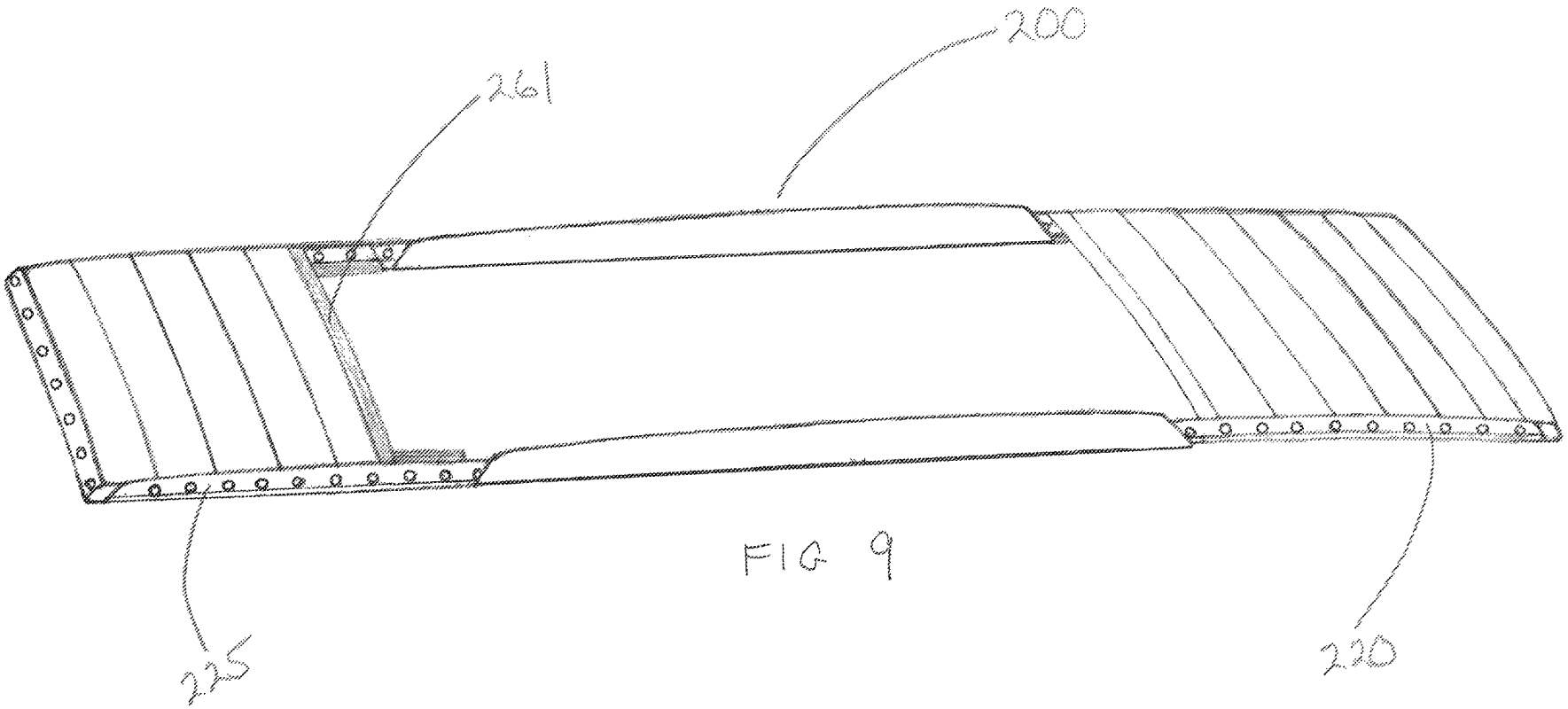

FIG. 9 presents a fore/aft extended Retractable Shade Apparatus for Boats.

Figure 10:
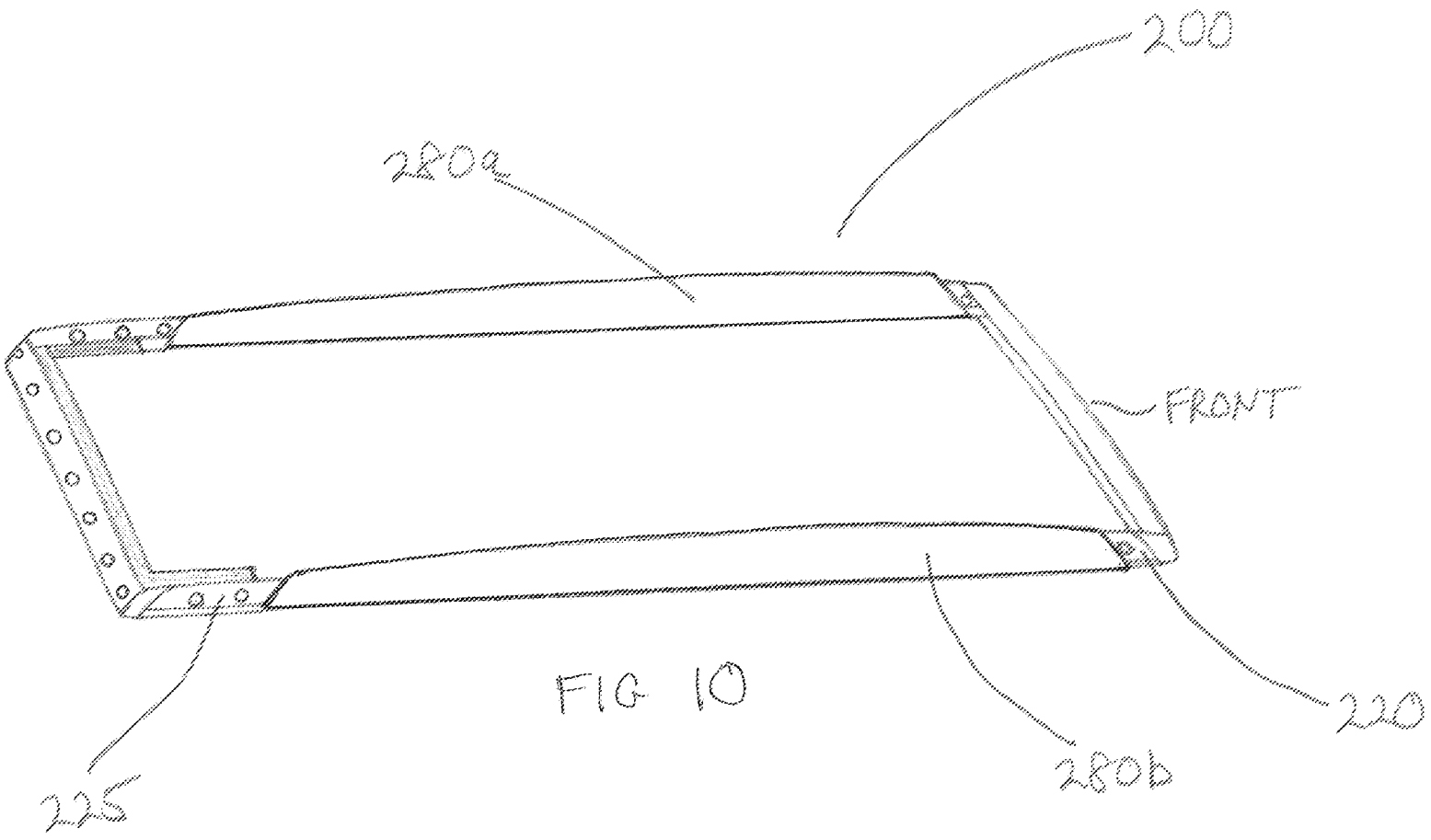

FIG. 10 presents a fore/aft retracted Retractable Shade Apparatus for Boats.

Figure 11:
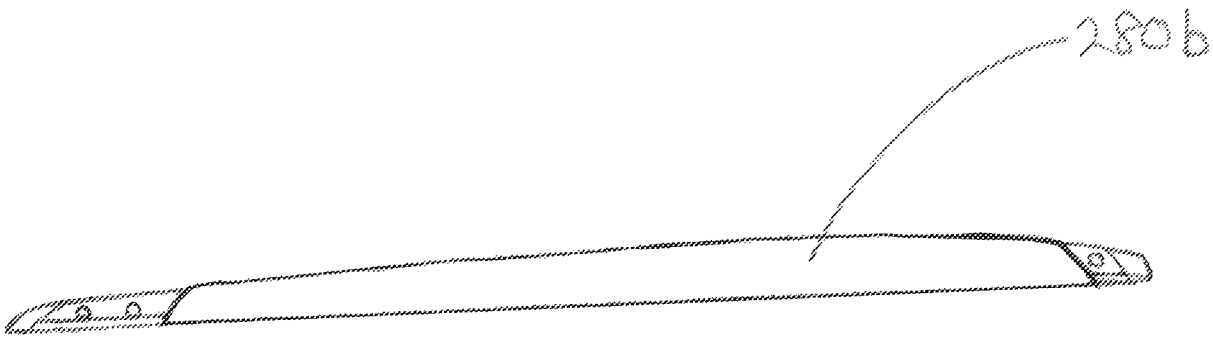

FIG. 11 presents a covered Retractable Shade Apparatus for Boats.

Figure 12:
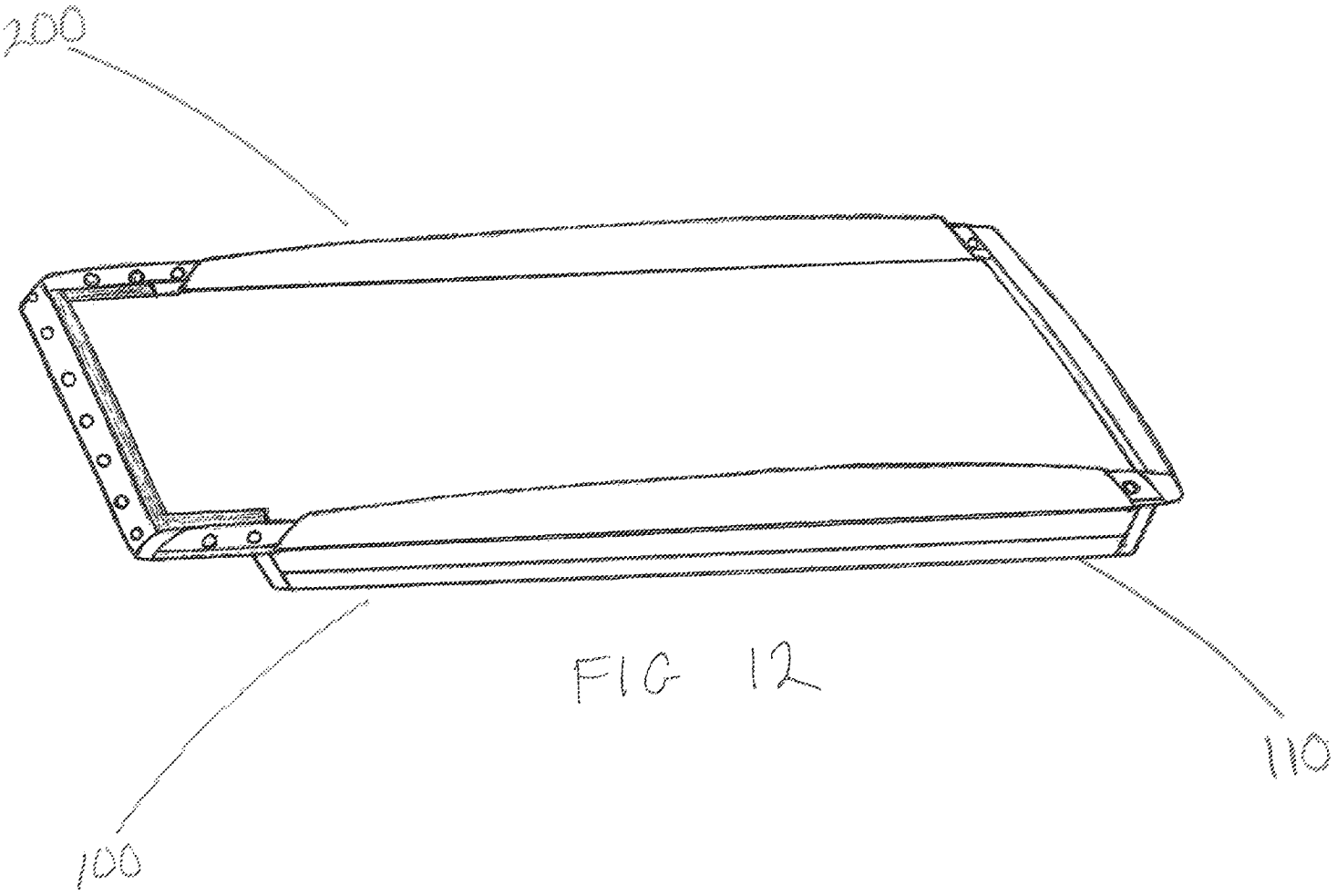

FIG. 12 presents a Retractable Shade Apparatus for Boats having a mounting support base.

Figure 13:
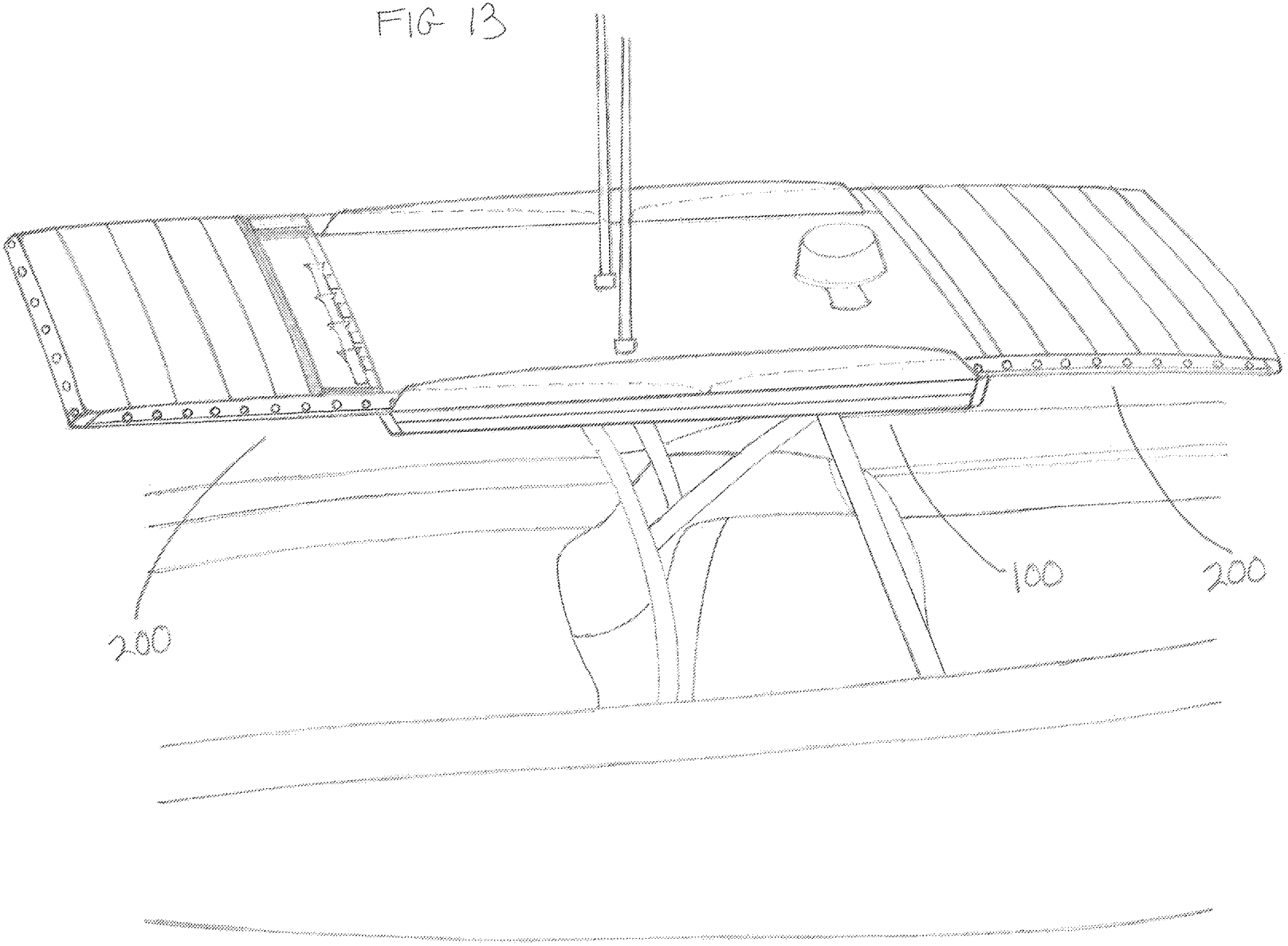

FIG. 13 presents a fore/aft extended Retractable Shade Apparatus for Boats attached to a boat T-top.

Figure 14:
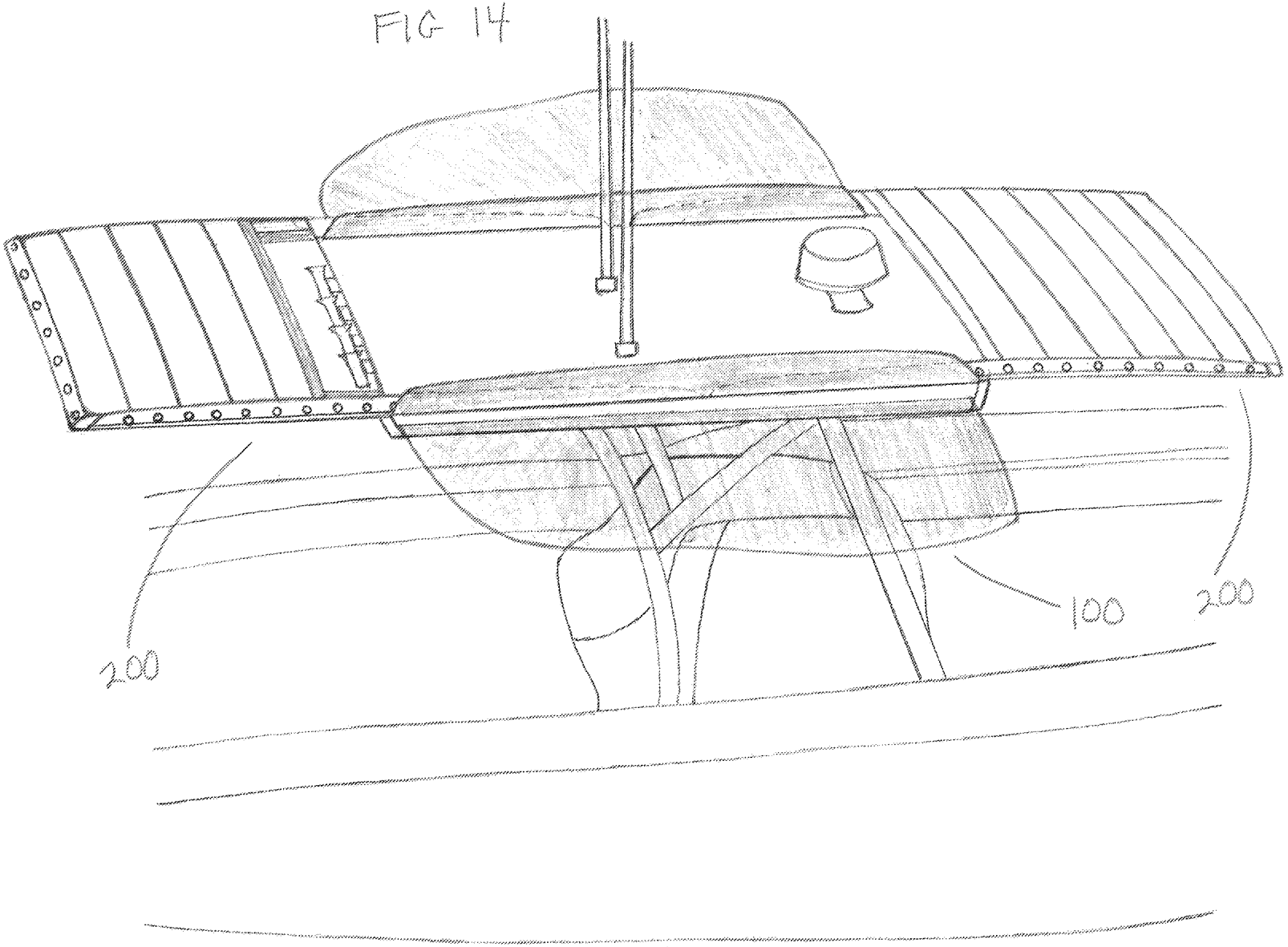

FIG. 14 presents a fore, aft, and side extended Retractable Shade Apparatus for Boats attached to a boat T-top.

Figure 15:
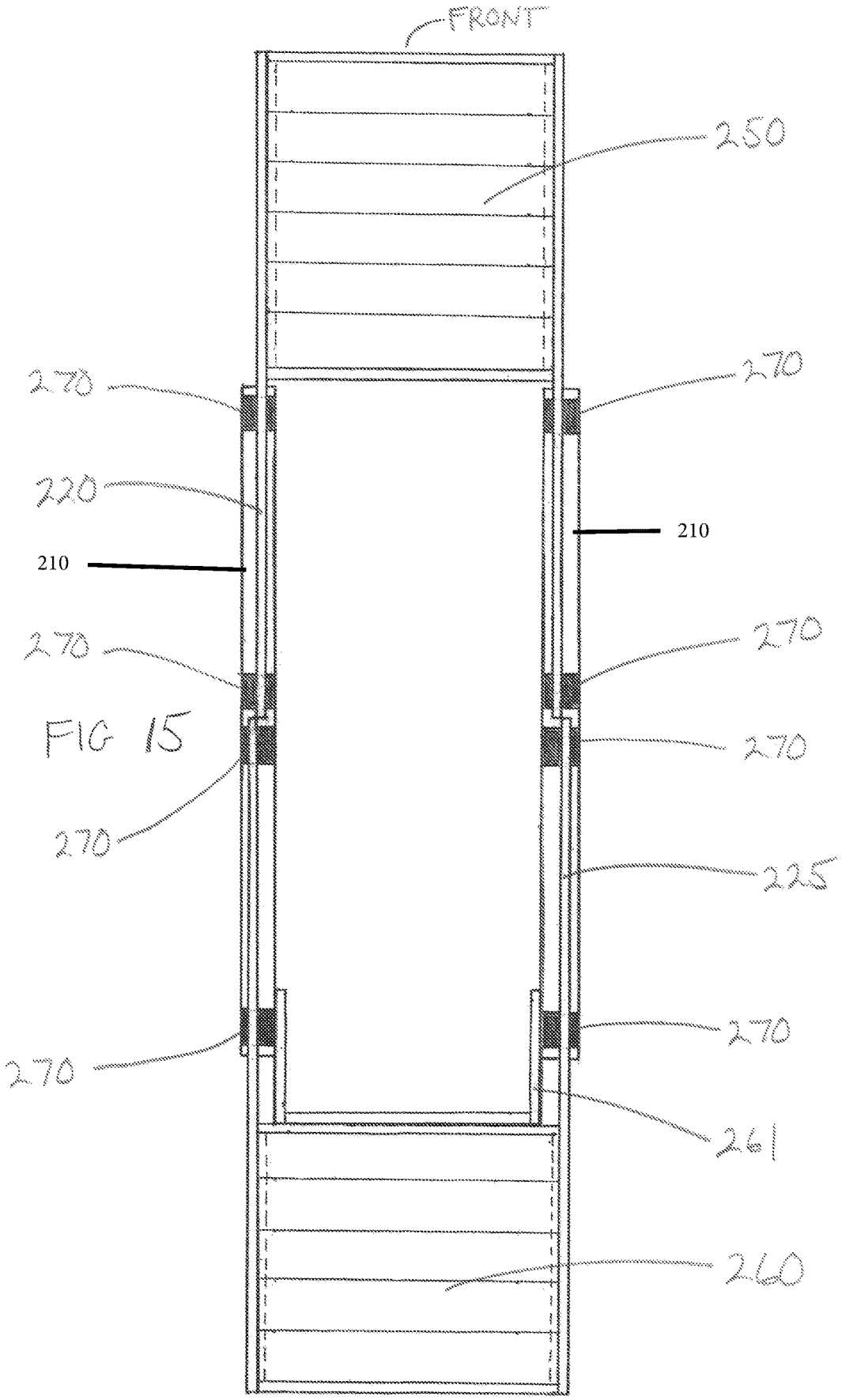

FIG. 15 presents a fore/aft extended Retractable Shade Apparatus for Boats.

Figure 16:
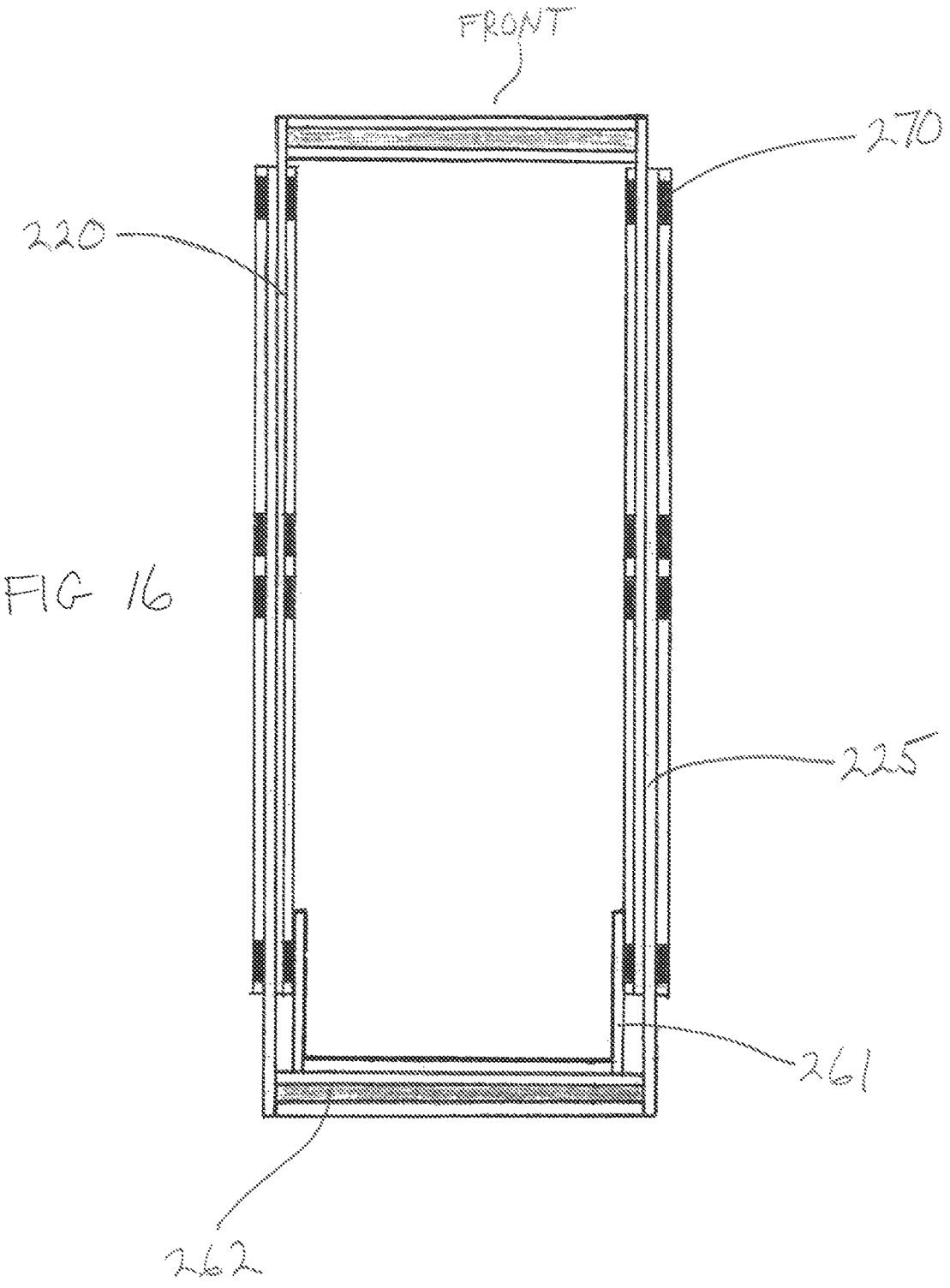

FIG. 16 presents a fore/aft retracted Retractable Shade Apparatus for Boats.

FIG. **16*a*** presents a fore/aft retracted Retractable Shade Apparatus for Boats.

Figure 17:
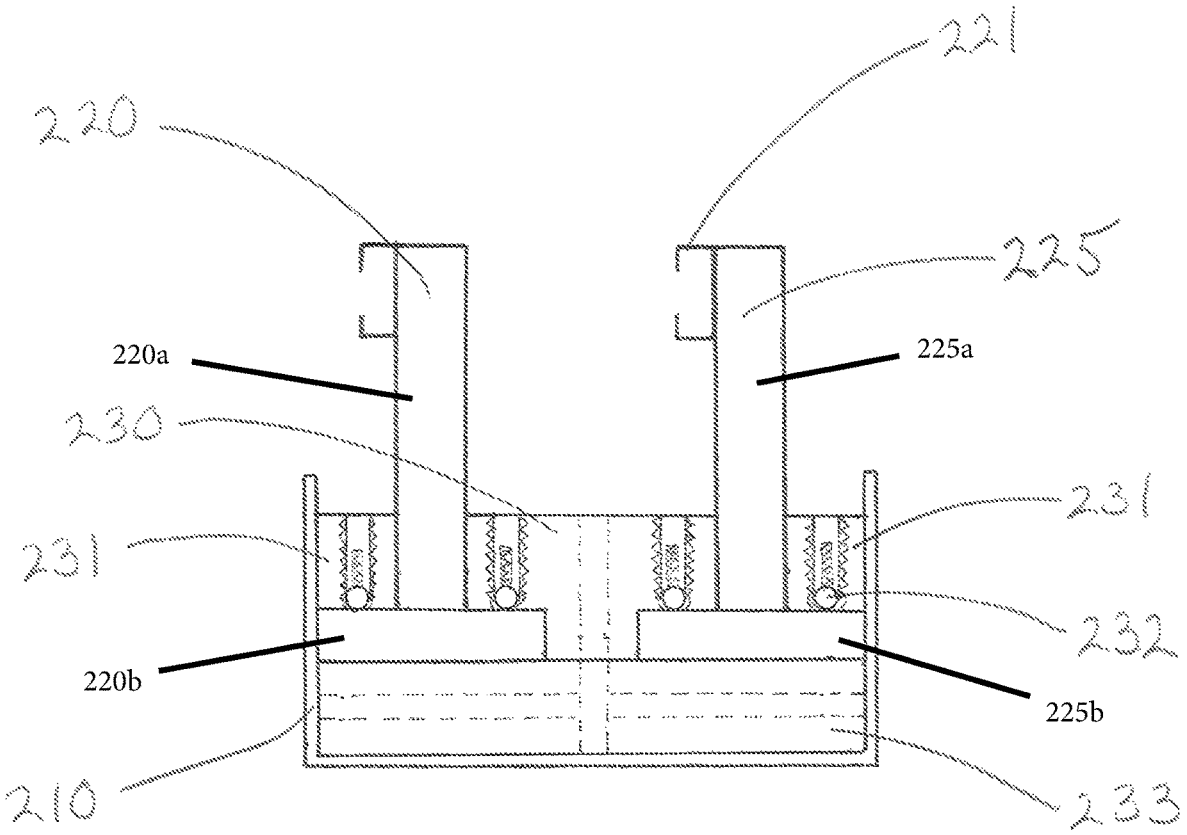

FIG. 17 presents sliding support members.

Figure 18:
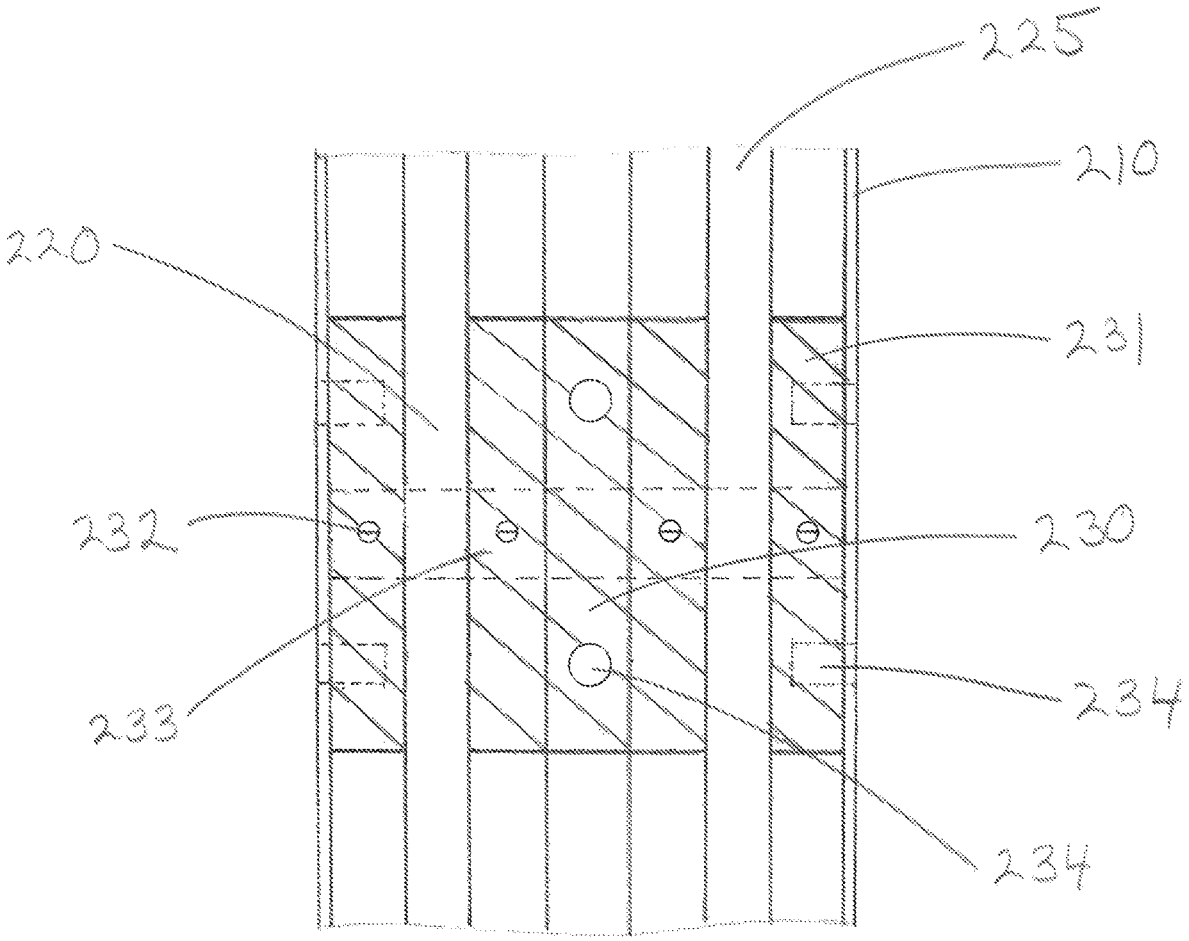

FIG. 18 presents sliding support members.

Figure 19:
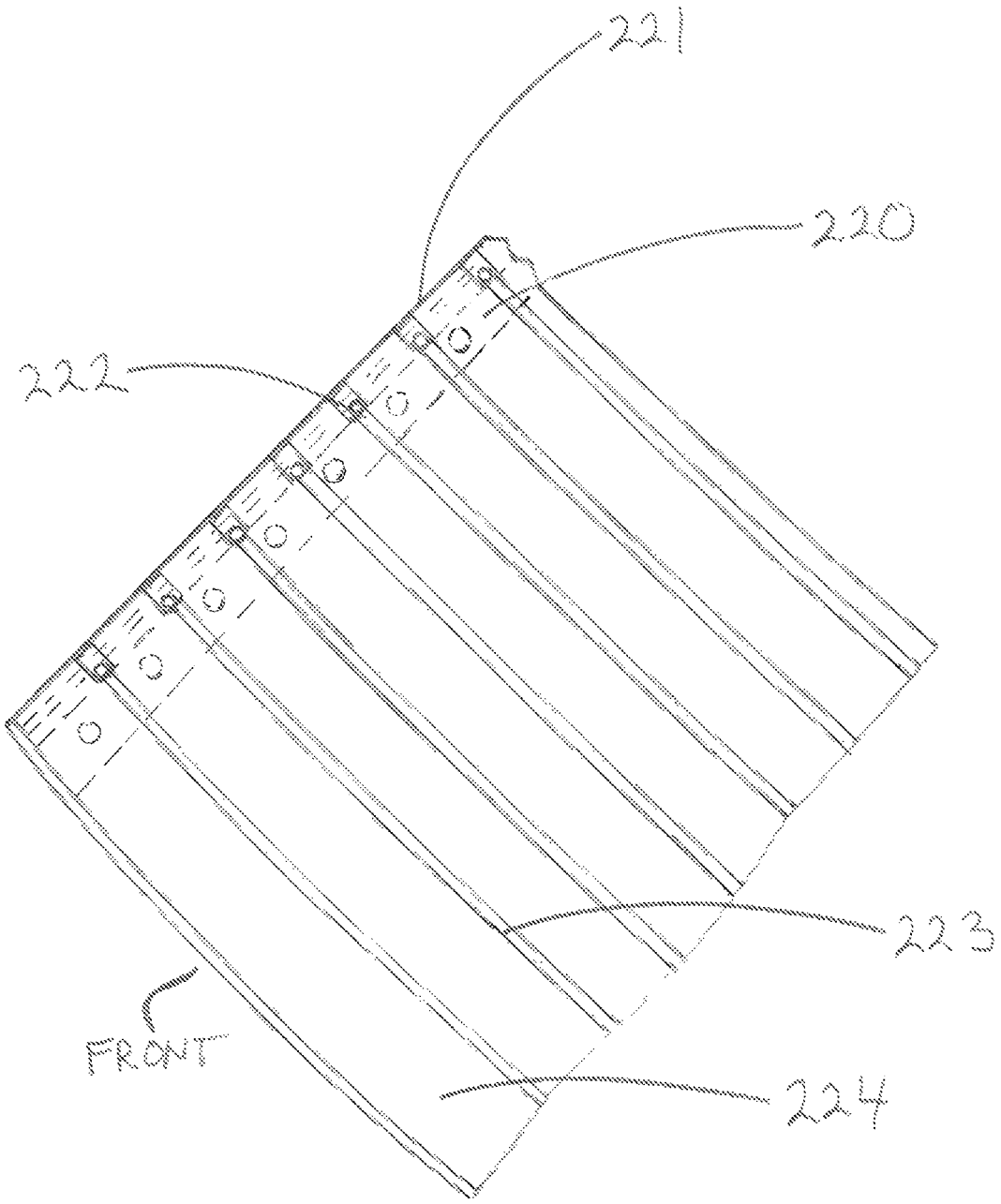

FIG. 19 presents an accordion type shade assembly.

Figure 20:
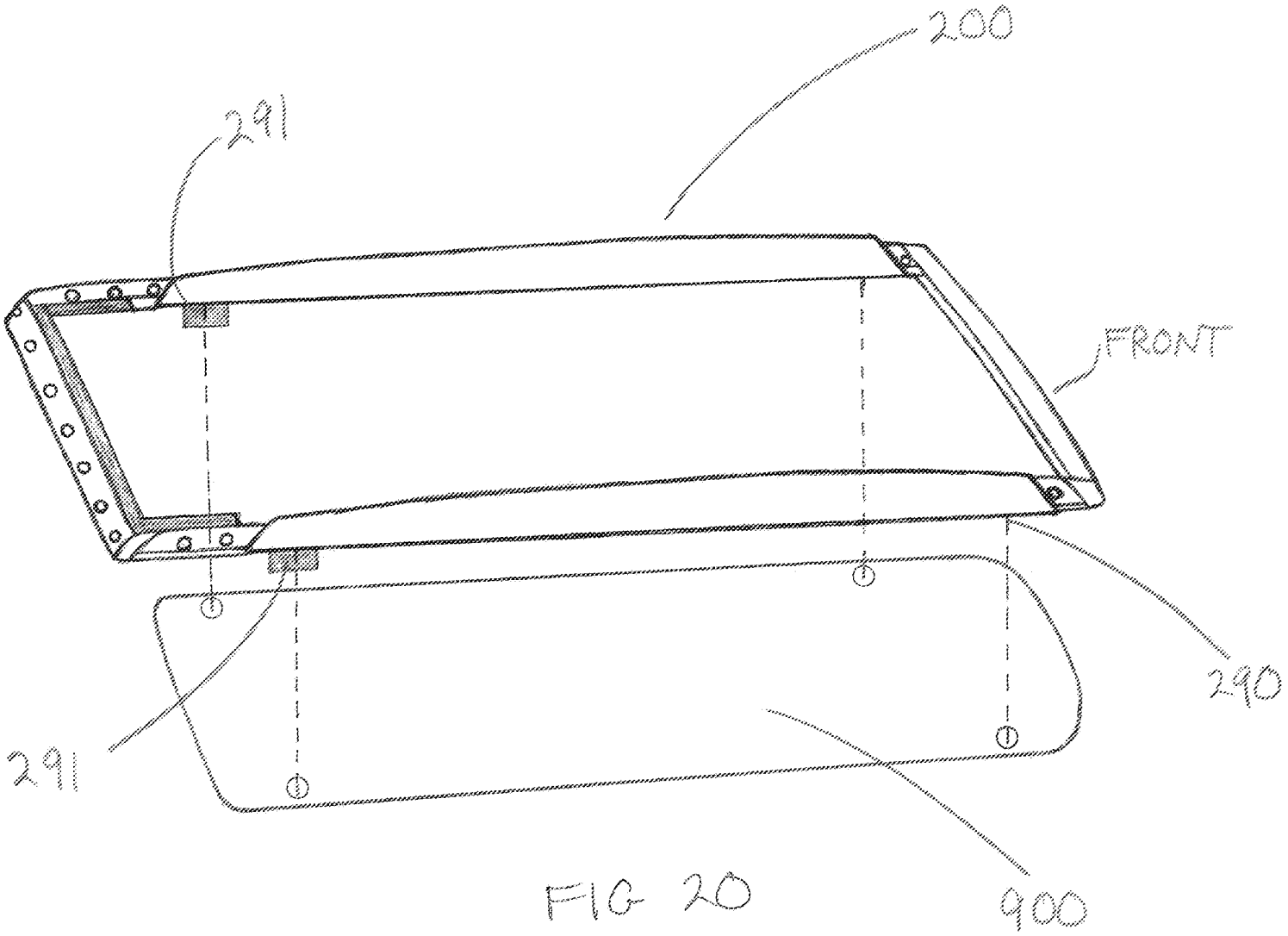

FIG. 20 presents a sliding shade assembly apparatus as attached to a framed structure such as a boat T-top.

FIG. **21*a*** is a side view of a Retractable Shade Apparatus for Boats attached to a boat tower structure.

FIG. **21*b*** is a top view of a Retractable Shade Apparatus for Boats attached to a boat tower structure.

Accordingly, the proper scope of the present apparatus should be determined only by the broadest interpretation of the appended claims so as to encompass all such modifications as well as all relationships equivalent to those illustrated in the drawings and described in the specification.

Other novel features which are characteristic of the apparatus, as to organization and method of operation, together with further objects and advantages thereof will be better understood from the following description considered in connection with the accompanying Figures, in which preferred embodiments of the apparatus are illustrated by way of example. It is to be expressly understood, however, that the Figures are for illustration and description only and is not intended as a definition of the limits of the apparatus. The various features of novelty which characterize the apparatus are pointed out with particularity in the claims annexed to and forming part of this disclosure. The apparatus resides not in any one of these features taken alone, but rather in the particular combination of all of its structures for the functions specified.

There has thus been broadly outlined the more important features of the apparatus in order that the detailed description thereof that follows may be better understood, and in order that the present contribution to the art may be better appreciated. There are, of course, additional features of the apparatus that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present apparatus. It is important, therefore, that the claims be regarded as including such equivalent constructions insofar as they do not depart from the spirit and scope of the present apparatus.

Further, the purpose of the Abstract is to enable the national patent office(s) and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the apparatus of this application, which is measured by the claims, nor is it intended to be limiting as to the scope of the apparatus in any way. Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

DETAILED DESCRIPTION OF THE INVENTION

The present invention, as shown in FIG. 1 thru 21*b*, presents a Retractable Shade Apparatus for Boats which includes a variety of embodiments and alternatively configured elements to allow users to selectively optimize the overhead coverage area.

Particularly and preferably, within the embodiments of the Retractable Shade Apparatus for Boats is an embodiment for use on center console type boats, including those, as shown in FIG. 3, utilizing a "T-top" type tower structure 900 and its T-top supports 901.

Generally, center console type boats offer minimal overhead coverage and do not provide adequate protection from harsh sun rays.

In typical use of the instant invention on a boat "T-top" type tower structure mounted to the center console 902, positioned between the boat gunwales 903, the Retractable Shade Apparatus for Boats is mounted to the T-top structure. The Retractable Shade Apparatus for Boats is then selectively extended and/or retracted to optimize the overhead coverage area (sun shade area).

As shown at least in FIG. 1 thru FIG. 8, the mounting support base 110 is bolted to the longitudinal side supports of the boat T-top 900 (see FIG. 4). At substantially equal intervals along the mounting support base, starting at the foremost end, pivot mechanisms 130 are utilized to provide a pivoting joint for a spine support base 131 that is bonded or bolted or otherwise attached to a spine 132. The spines are positioned to be substantially parallel when extended.

Fabric 120 is stretched from the foremost spine to the rearmost end of the mounting support base using sewn or otherwise attached spine pockets 122 to enable the fabric to move with the pivoting action of the spines from an extended position to provide shade to a retracted position for storage. The fabric may include a serrated leading edge 121 (see FIG. 1) to reduce wind noise and apertures 123 (see FIG. 7) to relieve excess or direct air pressure. The fabric is one piece for the port side and one piece for the starboard side.

A gas spring 111 (see FIGS. 1, 4, 5, 7) is attached to the front spine support base with a ball stud 133 (see FIG. 6) and the mounting support base 110 with a ball stud (not shown) to provide force to keep the front spine extended. In a retracted position (see FIG. 5) the spines along with the fabric are folded into the open end of the mounting support base 110 and kept in place with a strap or tucked into a zippered closure 112 (see FIG. 2). A cap insert 113 may be used at the end of the mounting support base. Mounting holes 115 provide a means of attachment to the T-top. Spacers 140 (made of nylon or similar material) provide support for pivoting movement of the spine support base.

Note that in at least FIG. 5 the spines 132 are aligned in a straight line. This configuration allows for a plurality of pivot points 130 along the mounting support base 110 thus enabling a broader area of coverage that spans from the front of the mounting support base to the rear with no gaps as in single pivot radial design.

The Retractable Shade Apparatus for Boats is designed for use on multiple types of boats with various tower configurations. Easily adaptable to fit on a fixed frame structure, a fixed hardtop structure, or a pivotable frame or hardtop structure, such as a cargo rack apparatus.

As shown at least in FIG. 9 thru FIG. 21*b*, an embodiment of the instant invention includes an extendable/retractable sliding shade device 200 that translates fore and aft of a boat to provide adjustable sun coverage. The shade assembly translates fore and aft for selective use. High-strength supports enable use while at running speeds.

A plurality of parallel longitudinal support bases 210, as shown in at least FIG. 17, are attached to each other on a horizontal plane at least at the rear by a rear shade attachment support 261 shown in at least FIG. 15.

The longitudinal support bases 210 are aligned at equal distances from each other at the front and rear. The front of the longitudinal support bases may also be attached by a shade attachment support (not shown).

As shown in FIG. 15, a front shade assembly 250 and a rear shade assembly 260 slide, from a retracted position, in opposite directions to an extended position to provide shade. The front and rear shade assemblies operate independently of each other. It is conceived that in certain applications there may only be a front shade assembly and its necessary structural components or only a rear shade assembly and its necessary structural components.

Upon full extension, a stop mechanism such as a detent (not shown) on front sliding support member 220 and rear sliding support member 225 shown in FIG. 15, will limit the travel of the assembly. Front sliding support member 220 includes a post 220*a* and a base 220*b* positioned at one end of the front sliding support member post 220*a*. Rear sliding support member 225 includes a post 225*a* and a base 225*b* positioned at one end of the rear sliding support member post 225*a*.

A plurality of guide assemblies 270 (FIG. 15) attached to the longitudinal support bases 210 (FIG. 17) allow for the smooth movement of the front and rear shade assemblies.

As shown in at least FIG. 17, the sliding support members for the front shade assembly are adjacent to the sliding support members for the rear shade assembly on the same horizontal plane.

An embodiment of the instant invention provides for the front sliding support members 220 to be innermost of the rear sliding support members 225.

An alternate embodiment may have the rear sliding support members 225 innermost of the front sliding support members 220.

The front and rear sliding support members 220/225 slide fore and aft respectively. The long length of each sliding support member allows for full extension of the shade assemblies without the use of telescoping.

The benefits of a long, one-piece sliding support member are 1) a reduction in the probability of mechanical failure due to sticking or misalignment, and 2) the elimination of upward and downward movement usually referred to as play. This upward and downward play is due to challenges in manufacturing very tight tolerances between the moving parts of a telescoping mechanism at an affordable cost. The one-piece sliding support member design is a simpler method of achieving the extension required.

As shown in at least FIG. 17, the guide assemblies allow for the smooth, rattle free, movement/translation of the sliding support members. The guide assemblies 270 utilize a plurality of rollers 233 positioned under the sliding support member bases 220*b*/225*b* and a plurality of guides, including center guide 230 and side guides 231 made from material selected for frictional properties (such as Delron or a similar material) positioned above the sliding support members bases 220*b*/225*b*. Guide mounting holes 234 are positioned to not interfere with the movement of the sliding support members.

As shown in at least FIGS. 15, 16, 17 and 18, the sliding support members ride on top of the plurality of rollers 233 (see FIGS. 17 and 18). One roller 233 is positioned under the sliding support members for each guide assembly that is shown in FIGS. 15 and 16. A view of roller 233 is shown in FIG. 17. The guides allow the sliding support members to slidably move forward and rearward freely without enclosing them in any type of tubular structure that restricts their movement through excess friction.

At least one adjustable tensioner 232, such as a ball and spring, is used to minimize play between the guides and the sliding support member.

As shown in at least FIG. 19, the shade assembly is of an accordion type. Particularly, a spring-loaded roller with shade material may be used as an alternative, as known to be used for window shades and shade devices for boats.

Sliding connectors 222 slide fore and aft within a shade track 221, as shown in at least FIGS. 17 and 19. The sliding connectors are attached to a plurality of supports 223 that are positioned within sleeves or pockets in the shade material 224.

The shade track for the port side is attached to the inside of the port side sliding support member. The shade track for the starboard side is attached to the inside of the starboard side sliding support member.

When in the retracted position as shown in at least FIG. 16, the rear shade material 262 folds and compresses between the rear shade attachment support and the end support of the rear shade assembly. It is conceived that there may be a protected area for the folded shade material.

As shown in at least FIG. 10, optionally provided is a—port cover 280*a* and starboard cover 280*b*—that are attached to the longitudinal support base to protect the moving mechanisms from the weather and/or environment and to keep it free from dirt.

As shown in at least FIG. 12, the mounting support base 110 (see FIG. 8) of the pivoting port/starboard shade assembly 100 may be attached to the longitudinal support base 210 (see FIG. 17) of the sliding fore/aft shade assembly 200.

Specifically, as shown in FIGS. 12-14, the shade created by the fully extended apparatus may be provided by a combination of the pivoting port/starboard shade assembly 100 and the extendable/retractable sliding shade device 200.

Figure 16A:
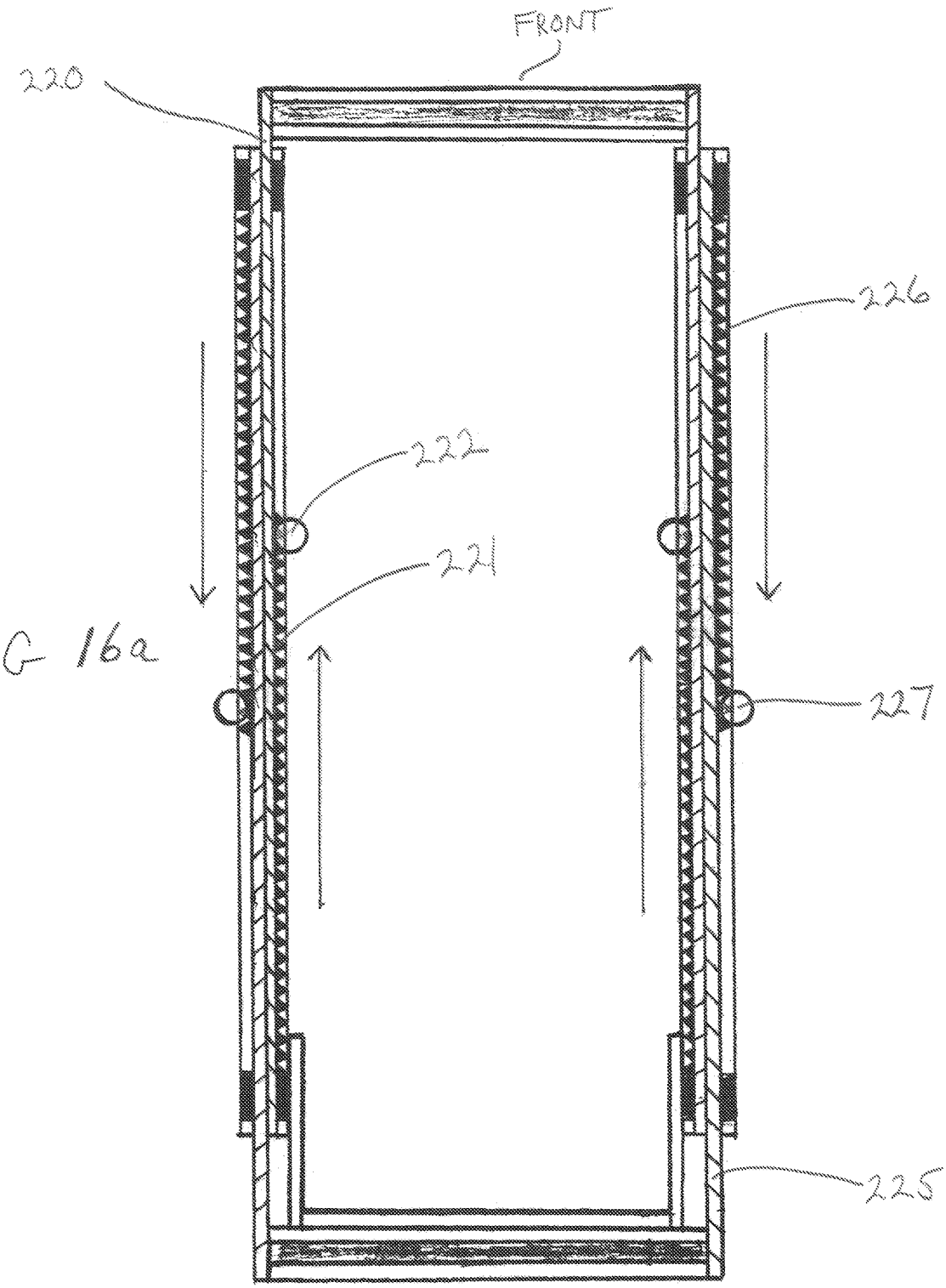

As shown in FIG. 16*a*, at least one front gear rack 221 is attached to the front sliding support member 220. At least one reversible motor 222 that may utilize gearing (such as a pinion gear arrangement, worm gear arrangement, bevel gear arrangement, etc.) which is attached to the longitudinal support base as a means for driving the at least one gear rack to move the front sliding support member forward and backward. At least one rear gear rack 226 is attached to the rear sliding support member 225. At least one reversible motor 227 that may utilize a gearing arrangement (such as a pinion gear arrangement, worm gear arrangement, bevel gear arrangement, etc.) is attached to the longitudinal support base as a means for driving the at least one gear rack to move the rear sliding support member backward and forward.

As shown in FIG. 20, the complete sliding shade apparatus 200 may be attached to a framed structure such as a boat T-top 900 with a plurality of bolts or clamp connectors 290. Spacers 291 may be added to the rear to adjust for the proper angle.

Figure 21A:
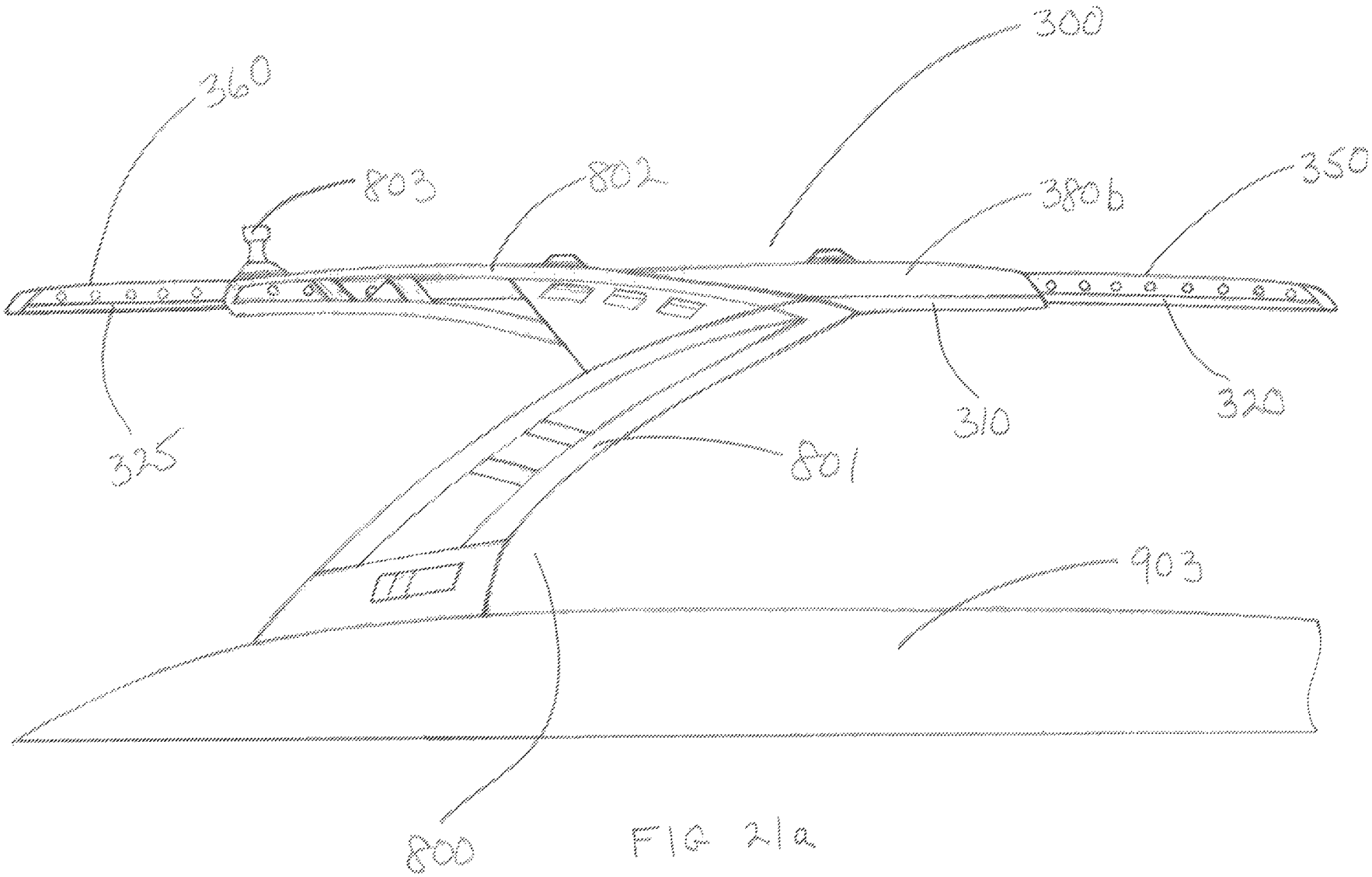
Figure 21B:
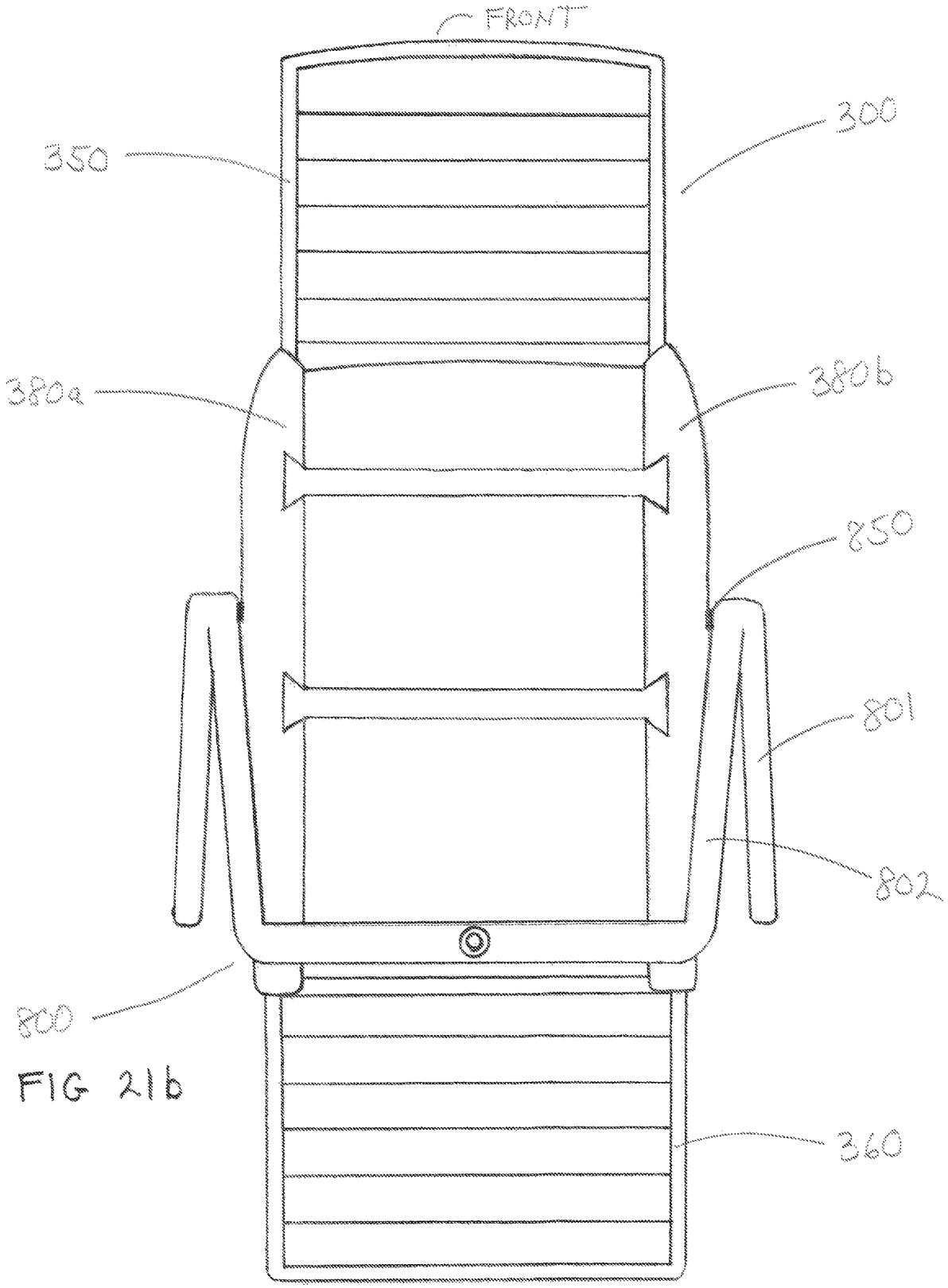

An alternative embodiment as shown in at least FIGS. 21*a* and 21*b* presents the retractable sliding shade device 300 pivotally attached by means of a pivot mechanism 850 (such as a bolt, ball and socket, or pivot pin), to a wakeboard tower 800 to provide adjustable shade.

The front shade assembly 350 extends and retracts utilizing the front sliding support member 320 and support track 310. The rear shade assembly 360 extends and retracts utilizing the rear sliding support member 325 and the support track 310.

The front and rear shade assemblies operate independently of each other. It is conceived that in certain applications there may only be a front shade assembly and its necessary structural components or only a rear shade assembly and its necessary structural components.

The sliding shade device 300 is attachable to the upper tower legs 802 and/or the lower tower legs 801 of the wakeboard tower 800 which is then attached to the boat gunwale 903. A ski tow 803 may be optionally provided. A port cover 380*a* and starboard cover 380*b* may be optionally provided.

The foregoing disclosure is sufficient to enable one having skill in the art to practice the apparatus without undue experimentation, and provides the best mode of practicing the apparatus presently contemplated by the inventor. While there is provided herein a full and complete disclosure of the preferred embodiments of this apparatus, it is not intended to limit the apparatus to the exact construction, dimensional relationships, and operation shown and described. Various modifications, alternative constructions, changes and equivalents will readily occur to those skilled in the art and may be employed, as suitable, without departing from the true spirit and scope of the apparatus. Such changes might involve alternative materials, components, structural arrangements, sizes, shapes, forms, functions, operational features or the like. Elements of the instant apparatus may be made from a variety of known materials including wood, rubber, metal, or plastic, as well as from any suitable combination of appropriate materials.

What is claimed:

1. An Extendable/Retractable Shade Apparatus for attachment to a boat tower or boat top or boat cargo rack comprising:

at least one sliding support member translating fore and aft of the boat;

the at least one sliding support member including at least one guide assembly;

and a shade assembly supported by each at least one guide assembly, wherein at least one shade assembly translates fore and aft along the at least one sliding support member;

wherein each at least one sliding support member is positioned within at least one longitudinal support base, and wherein the longitudinal support bases are interconnected by at least one shade attachment support;

wherein the at least one sliding support member includes a sliding support member post and a sliding support member base positioned at one end of the sliding support member post;

wherein rollers are positioned under the sliding support member base, and wherein at least one center guide is positioned above each sliding support member base to assist in providing smooth, rattle free, movement/translation of the sliding support members.

2. The Extendable/Retractable Shade Apparatus of claim 1 wherein at least one adjustable tensioner is provided between the at least one center guide and the at least one sliding support member base to assist in providing smooth, rattle free, movement/translation of the sliding support members.

3. The Extendable/Retractable Shade Apparatus of claim 1, wherein the at least one sliding support member includes at least one front sliding support member and at least one rear sliding support member.

4. The Extendable/Retractable Shade Apparatus of claim 3, wherein the at least one front sliding support member and the at least one rear sliding support members are positioned together within at least one longitudinal support base.

5. An Extendable/Retractable Shade Apparatus for attachment to a boat tower or boat top or boat cargo rack comprising:

a front sliding support member translating fore and aft of the boat;

a rear sliding support member translating fore and aft of the boat;

each sliding support member including at least one guide assembly; and a shade assembly supported by each at least one guide assembly, wherein the shade assembly translates fore and aft along the front and rear sliding support members:

wherein the at least one sliding support member includes a sliding support member post and a sliding support member base positioned at one end of the sliding support member post;

wherein rollers are positioned under the sliding support member base, and wherein at least one center guide is positioned above each sliding support member base to assist in providing smooth, rattle free, movement/translation of the sliding support members.

6. The Extendable/Retractable Shade Apparatus of claim 5, wherein at least one adjustable tensioner is provided between at least one center guide and the at least one sliding support member base to assist in providing smooth, rattle free, movement/translation of the sliding support members.

7. An Extendable/Retractable Shade Apparatus for attachment to a boat tower or boat top or boat cargo rack comprising:

at least one mounting support base for attachment to the boat tower or boat top or boat cargo rack;

a plurality of pivot mechanisms provided on the at least one mounting support base, wherein the pivot mechanisms are sequentially aligned with each other, and wherein the pivot mechanisms rotate about an axis perpendicular to the sequential alignment;

a spine extending from each pivot mechanism, wherein when fully extended each spine is substantially parallel to another spine; and fabric interconnecting the plurality of spines formed where the plurality of pivot mechanisms includes a spine extending from each pivot mechanism.

8. The Extendable/Retractable Shade Apparatus of claim 7, wherein the fabric extends from foremost spine to the rearmost end of the mounting support base.

9. The Extendable/Retractable Shade Apparatus of claim 7, wherein the plurality of pivot mechanisms are aligned in a straight line thereby providing a plurality of pivot points along the mounting support base thus enabling a broad area of fabric coverage that spans from a front of the mounting support base to a rear of the mounting support base.

10. The Extendable/Retractable Shade Apparatus of claim 7 further comprising:

wherein each spine further includes a spine support base; and at least one gas spring attaching together the spine support base and one of the at least one mounting support base to assist in keeping the spine in a selected position.

11. The Extendable/Retractable Shade Apparatus of claim 7 wherein in the retracted position the spines along with the fabric are folded into an open end of the at least one mounting support base.

12. The Extendable/Retractable Shade Apparatus of claim 1 further including a side guide positioned above the sliding support member base of each at least one sliding support member.

13. The Extendable/Retractable Shade Apparatus of claim 5 further including a side guide positioned above the sliding support member base of each at least one sliding support member.

* * * * *